US010299611B1

(12) United States Patent
O'Malley

(10) Patent No.: US 10,299,611 B1
(45) Date of Patent: May 28, 2019

(54) STACKABLE JEWELRY ORGANIZER AND METHOD OF USE

(71) Applicant: Kathryn O'Malley, River Forest, IL (US)

(72) Inventor: Kathryn O'Malley, River Forest, IL (US)

( * ) Notice: Subject to any disclaimer, the term of this patent is extended or adjusted under 35 U.S.C. 154(b) by 0 days.

(21) Appl. No.: 15/275,104

(22) Filed: Sep. 23, 2016

Related U.S. Application Data

(60) Provisional application No. 62/232,131, filed on Sep. 24, 2015, provisional application No. 62/309,877, filed on Mar. 17, 2016, provisional application No. 62/335,361, filed on May 12, 2016.

(51) Int. Cl.

| | |
|---|---|
| ***A45C 11/04*** | (2006.01) |
| ***A47F 7/03*** | (2006.01) |
| ***B65D 21/02*** | (2006.01) |
| ***B65D 1/34*** | (2006.01) |
| ***A47F 7/02*** | (2006.01) |

(52) U.S. Cl.
CPC ..... *A47F 7/03* (2013.01); *A47F 7/02* (2013.01); *B65D 1/34* (2013.01); *B65D 21/0233* (2013.01)

(58) Field of Classification Search
CPC ... A47F 7/03; A47F 7/022; A47F 7/02; B65D 1/34; B65D 21/0233
USPC ..... 206/6.1, 378, 566, 564, 557, 505, 519, 206/499
See application file for complete search history.

(56) References Cited

U.S. PATENT DOCUMENTS

| | | | | |
|---|---|---|---|---|
| 4,311,235 | A * | 1/1982 | Titus | A45C 11/16 206/483 |
| 4,341,300 | A * | 7/1982 | Roy | A47F 7/02 206/523 |
| 4,848,585 | A * | 7/1989 | Snyder | A45C 11/16 206/315.11 |
| 5,035,319 | A * | 7/1991 | Kunisch | A45C 13/02 206/566 |
| 5,649,625 | A * | 7/1997 | Ovadia | A47F 7/02 206/493 |
| 6,158,578 | A * | 12/2000 | Greiner | A47F 5/10 206/6.1 |
| 6,334,530 | B1 * | 1/2002 | Morris | A47F 7/02 206/566 |
| 6,513,672 | B1 * | 2/2003 | Ovadia | A45C 11/06 206/6.1 |
| 7,367,449 | B2 * | 5/2008 | Kaminski | A45C 11/16 206/1.5 |
| 8,522,964 | B1 * | 9/2013 | Pledger | A47F 7/03 206/523 |
| 2004/0031702 | A1 * | 2/2004 | Mangano | A45C 7/0045 206/6.1 |

(Continued)

*Primary Examiner* — Rafael A Ortiz
(74) *Attorney, Agent, or Firm* — Charles T. Riggs, Jr.

(57) ABSTRACT

A countertop jewelry organizer configured to organize, store and display bangle bracelets and rings, having vertical columns to hold and showcase jewelry, and preferably two larger vertical columns for bracelets, and three smaller vertical columns for rings. The organizer includes an interior rim around the columns to define a tray area, adding an extra line of storage for other jewelry or items, and an exterior rim around the periphery forming a trough for further storage of other jewelry or items. These features also enable secured stack-ability of multiple organizers. An accessory in the form of a skin or overlay can be used in combination with the jewelry organizer.

20 Claims, 11 Drawing Sheets

(56) References Cited

U.S. PATENT DOCUMENTS

| | | | | |
|---|---|---|---|---|
| 2007/0017827 | A1* | 1/2007 | Urquhart | B65D 71/0003 206/162 |
| 2007/0284979 | A1* | 12/2007 | Greiner | A47B 45/00 312/309 |
| 2008/0135422 | A1* | 6/2008 | Martinez | A47F 7/02 206/6.1 |
| 2009/0139878 | A1* | 6/2009 | Wejrowski | A47B 67/005 206/6.1 |
| 2014/0048428 | A1* | 2/2014 | Sakamoto | A45C 11/16 206/6.1 |

* cited by examiner

STACKABLE JEWELRY ORGANIZER AND METHOD OF USE

RELATED APPLICATIONS

This application relates to and claims priority to co-pending U.S. provisional patent application no. 62/232,131 with the same title, filed Sep. 24, 2015, and co-pending U.S. provisional patent application no. 62/309,877 with the same title, filed Mar. 17, 2016, and co-pending U.S. provisional patent application no. 62/335,361 with the same title, filed May 12, 2016, the entire disclosures of which are incorporated herein.

BACKGROUND

There exist a variety of jewelry boxes and trays for the storage of jewelry. For the most part however, jewelry is simply haphazardly place on or into such existing jewelry boxes and trays, and often becomes disorganized, tangled and/or difficult to locate and retrieve a specific piece of jewelry. Further, the jewelry in such existing boxes and trays often becomes a jumbled pile of different types of jewelry, which is an eyesore.

Accordingly, to address and overcome the inefficiencies, limitations and disadvantages of existing jewelry boxes and trays described above, an improved jewelry organizer is needed which organizes, stores and displays different types of jewelry, makes finding and retrieving a particular type of piece of jewelry extremely easy, and which is lightweight, portable and stackable. The jewelry organizer and method of use disclosed herein fulfill such needs. It is desired that the presently disclosed product and method be applicable generally to any instances or applications involving the organization, storage and display of items, especially annularly shaped items.

SUMMARY

The present disclosure relates to a jewelry organizer for organizing, storing, and displaying different types of jewelry, including but not limited to bangle bracelets, rings, and miscellaneous jewelry products, all in one place, while keeping the area surrounding the organizer, such as a dresser, de-cluttered and clean. The organizer has one or more vertical columns for receiving annularly shaped jewelry such as bracelets and rings, an inner rim around the vertical columns and defining a tray area for receiving miscellaneous jewelry or other items, and an outer rim or flange defining a trough for receiving miscellaneous jewelry or other items. Preferably, the jewelry organizer has a plurality of larger vertical columns for holding bracelets, and a plurality of smaller vertical columns for holding rings. The organizer is lightweight, portable and stackable. An accessory in the form of a skin or overlay can be used in combination with the jewelry organizer.

DETAILED DESCRIPTION

Figure 1:
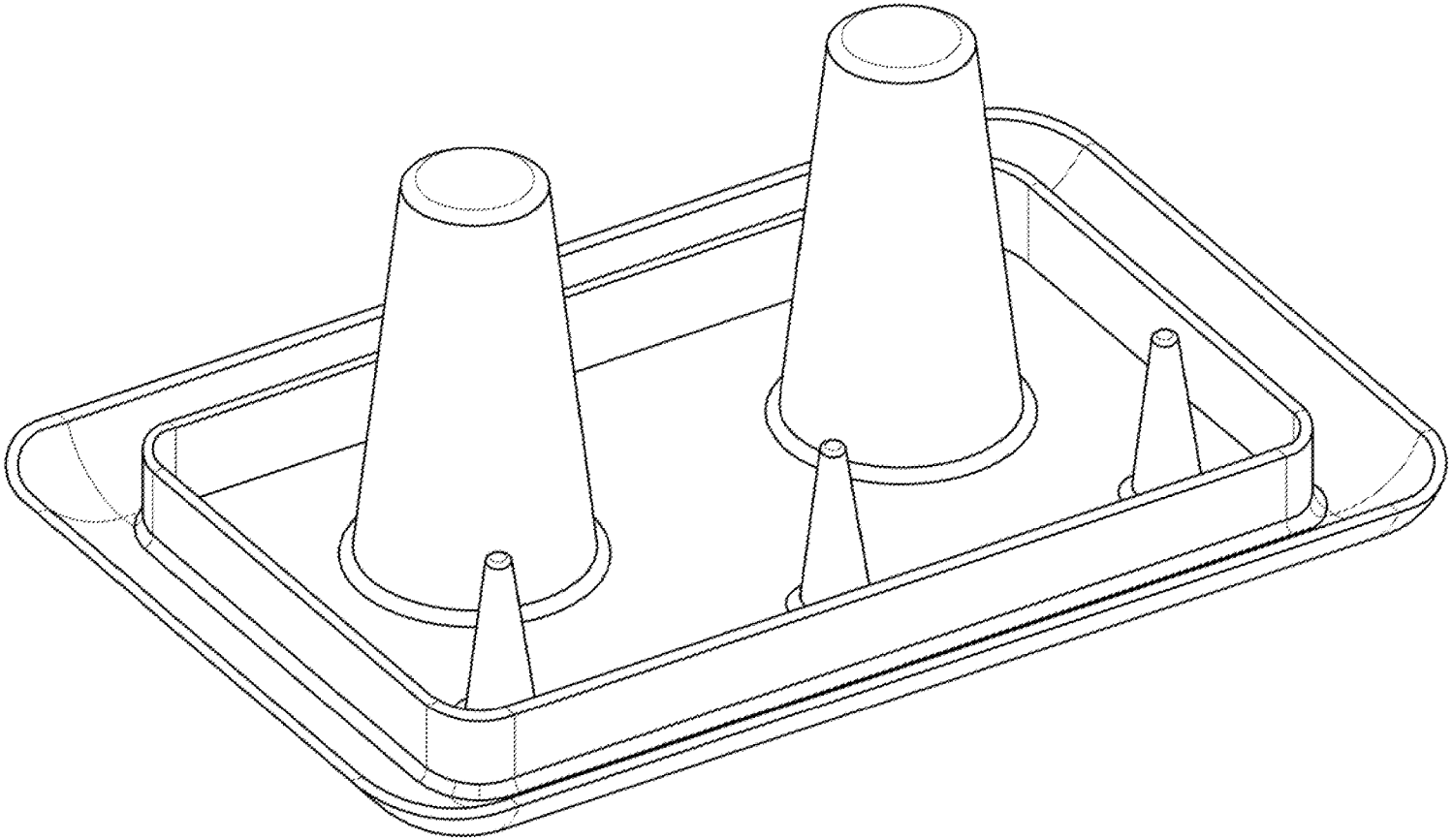
FIG. 1 is a perspective view of the jewelry organizer of the present disclosure.
Figure 2:
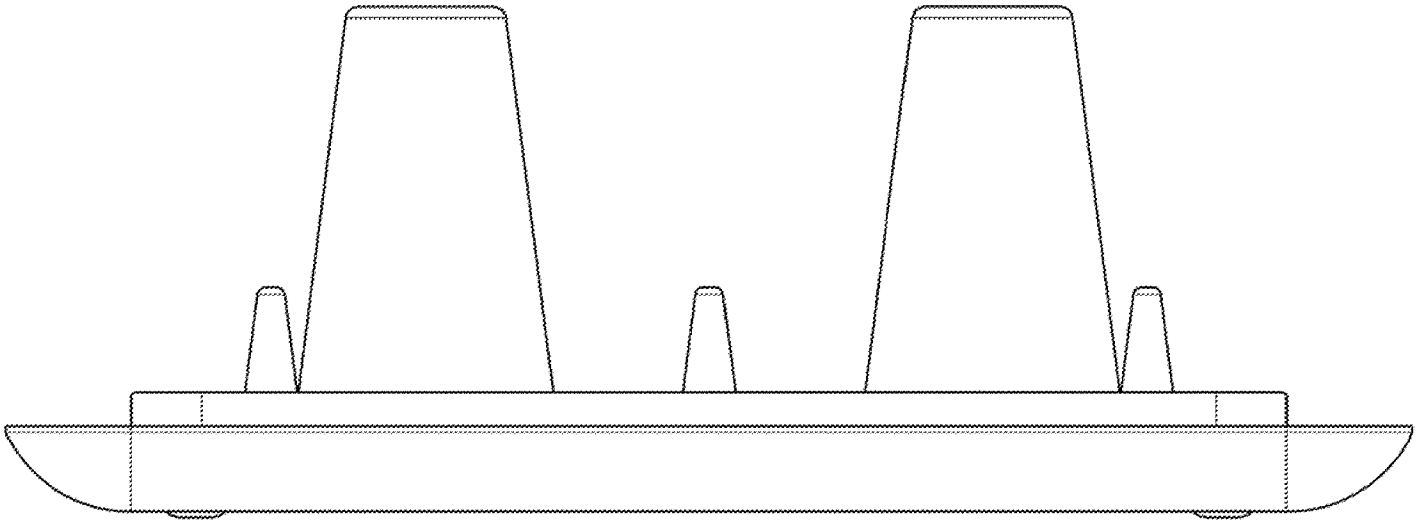
FIG. 2 is a side view of the jewelry organizer of the present disclosure.
Figure 3:
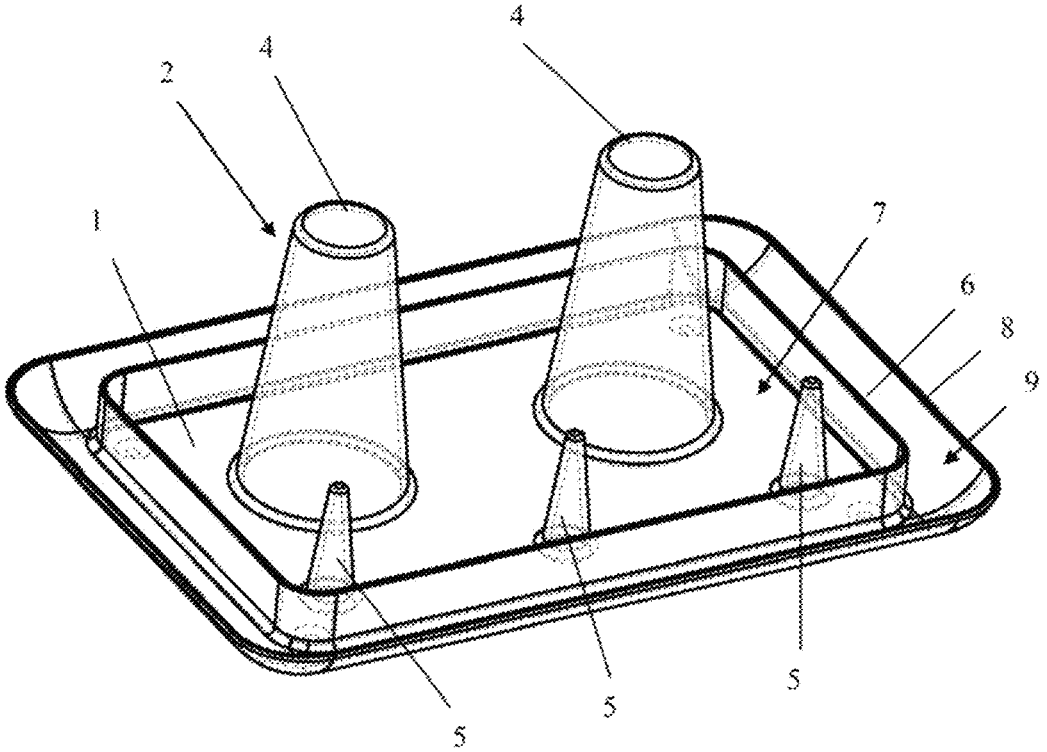
FIG. 3 is a line drawing of a perspective view of the jewelry organizer with hidden lines to represent edges and/or contours that are not directly visible.
Figure 4:
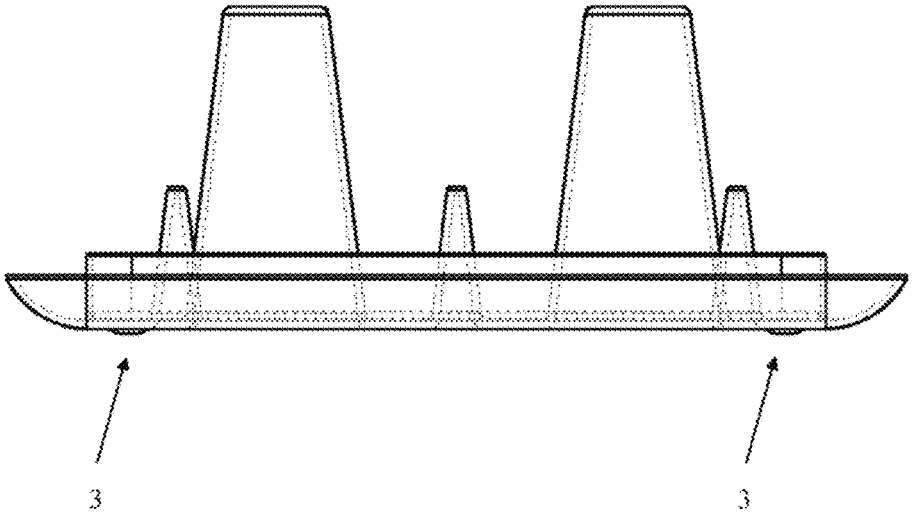
FIG. 4 is a line drawing of a side view of the jewelry organizer with hidden lines to represent edges and/or contours that are not directly visible.
Figure 5:
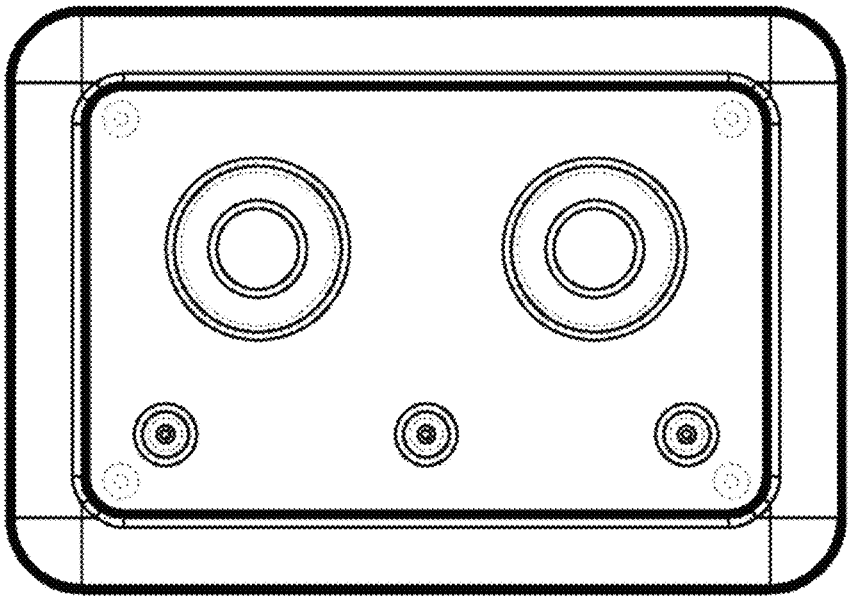
FIG. 5 is a line drawing of a top view of the jewelry organizer with hidden lines to represent edges and/or contours that are not directly visible.

As can be seen in the drawing FIGS. 1-8, the jewelry organizer of the present disclosure comprises a generally flat base portion or tray 1, from which rise one or more columns 2, which may take any suitable shape, however which are preferably conical. Further, the base is illustrated a being generally rectangular, but could take any suitable shape such as square, circular or oval, etc. As illustrated, the base may be provided with feet or pads 3 for resting the jewelry organizer on a surface such as on top of a dresser.

Figure 8:
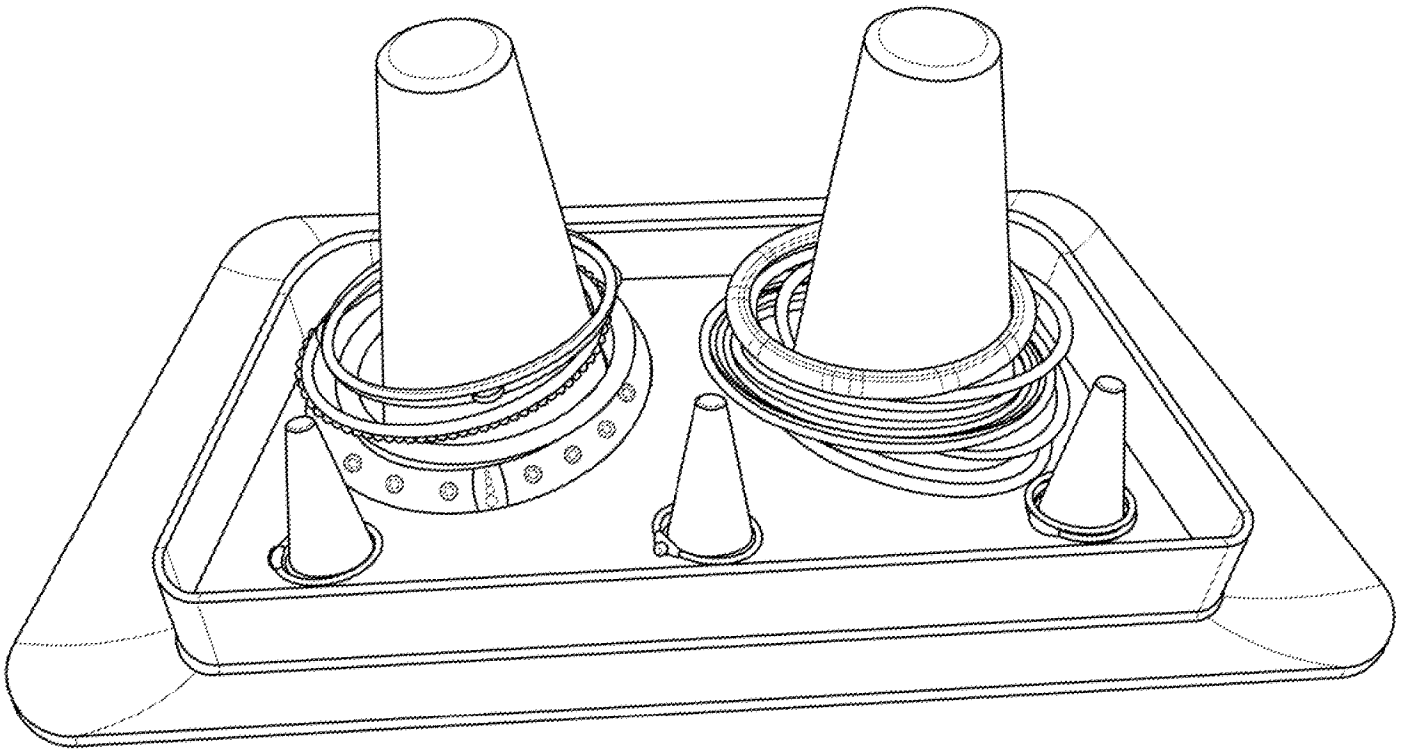
FIG. 8 is a perspective view of the jewelry organizer of the present disclosure in use.

Preferably, the jewelry organizer includes a plurality of larger columns 4, two illustrated, and a plurality of smaller columns 5, three illustrated. It should be understood that more or less columns of each size or of further different sizes are contemplated. In a preferred embodiment, the larger columns are sized and shaped to receive and display bracelets there around, while the smaller columns are sized and shaped to receive and display rings there around, as illustrated in FIG. 8. The columns allow the respective jewelry to stay organized and be displayed neatly, and make it easy for a user to find any particular piece of jewelry and simply lift that specific piece of jewelry from the column around which it has been placed.

The jewelry organizer also comprises an inner rim 6 around the columns and defining a tray area 7 such that items may be placed on the generally flat base portion in the tray area defined by the inner rim 6. The inner rim defining the tray area can take any suitable shape and further can divide the tray area into one or more sections or compartments, which may differ in sizes, if desired.

The jewelry organizer further comprises an outer rim 8 or flange extending from and curving generally upward from the base and away from the inner rim, and together with the inner rim, defining a trough area 9 such that items may be placed in the trough area 9 defined by the outer rim or flange 8 and the inner rim 6. The outer rim or flange defining the trough area can take any suitable shape and further can divide the trough area into one or more sections or compartments, which may differ in sizes, if desired. The curvature of the outer rim or flange allows the user to easily slide items within the trough area up the curved slope of the outer rim or flange and into the gasp of the user.

Figure 6:
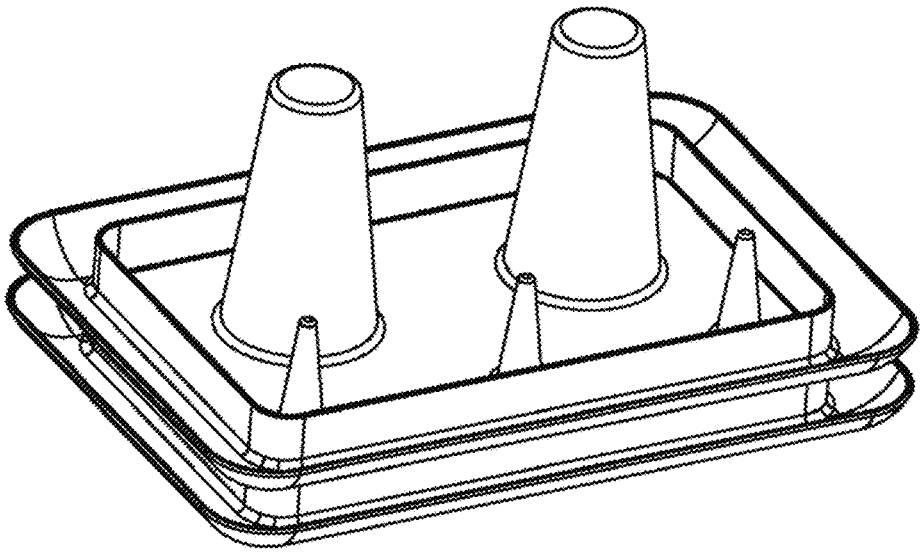
FIG. 6 is a line drawing of a perspective view of two of the jewelry organizers stacked together.
Figure 7:
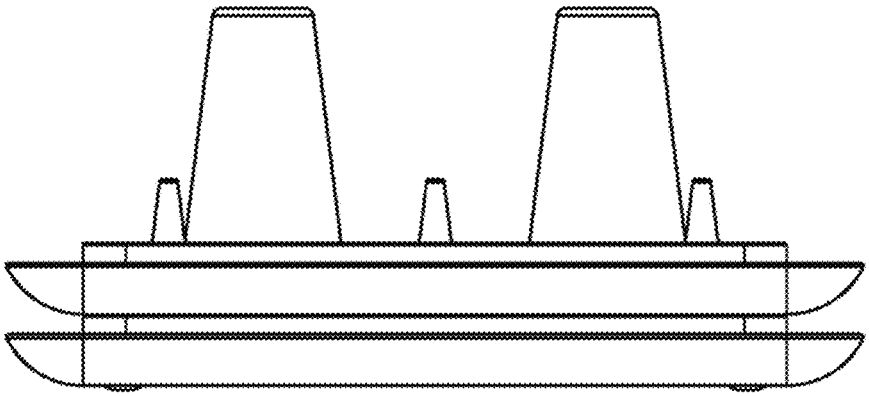
FIG. 7 is a line drawing of a side view of two of the jewelry organizers stacked together.

As can be seen in FIGS. 6 and 7, the jewelry organizer is stackable, such that one or more jewelry organizers can be placed over and/or on top of each other to form a stack. In order to achieve stack-ability of the jewelry organizers, the columns are hollow such that the columns of a lower jewelry organizer will extend up into, or inside of, the columns of an adjacent upper jewelry organizer in the stack. The inner rim of a lower jewelry organizer will generally abut against the base of an adjacent upper jewelry organizer in the stack, and generally align with the inner flange of the adjacent upper jewelry organizer in the stack.

The jewelry organizer is preferably formed of suitable molded plastic material or the like, such as acrylic, and can be tinted or colored as desired. The jewelry organizer is preferably light weight and portable. The jewelry organizer can be any suitable size and shape, and can have any suitable dimensions. In one embodiment, the jewelry organizer is rectangular with dimensions of approximately 10 inches wide and 7 inches long, with the larger columns holding thereon up to a 3.75" diameter bracelet. Further, the columns can be any suitable size and shape.

Figure 9:
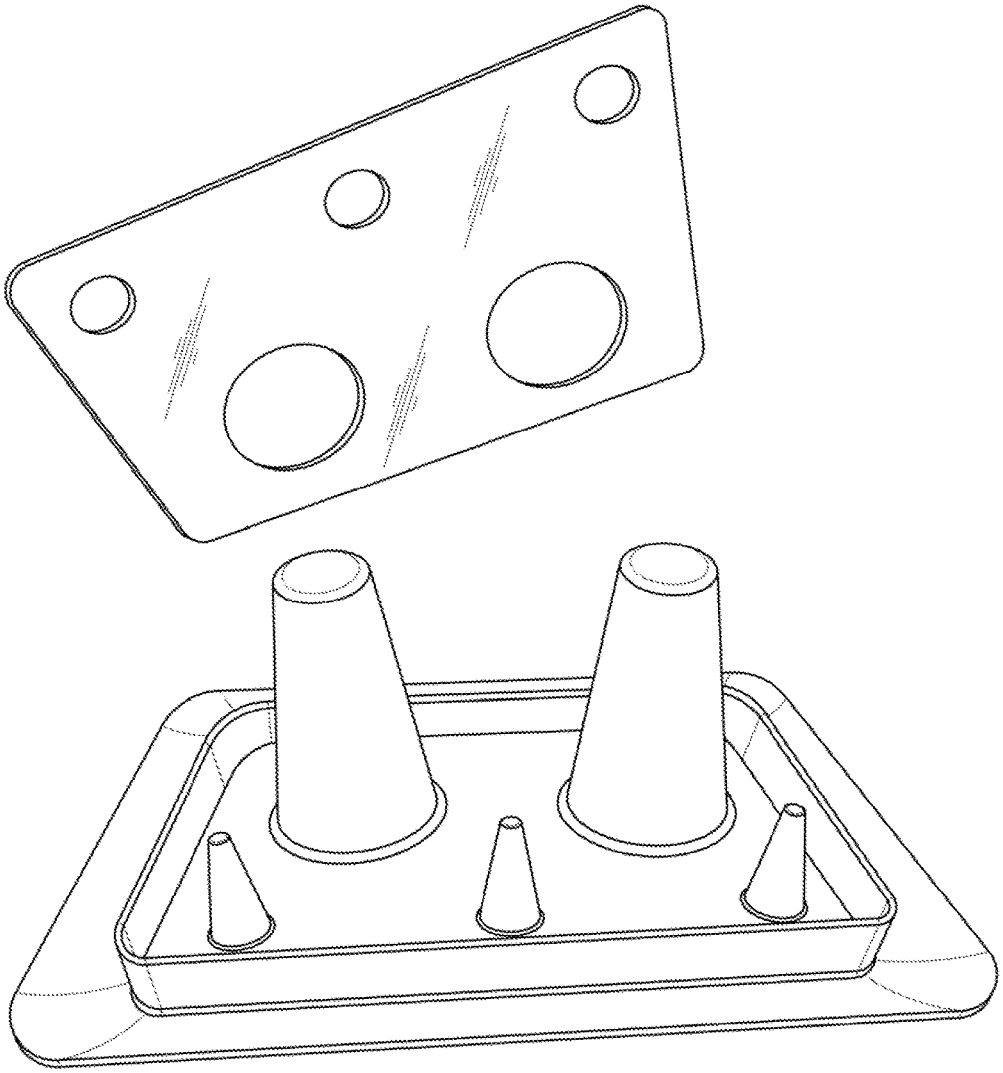
FIG. 9 is perspective view of an accessory used in connection with the jewelry organizer of the present disclosure.

FIG. 9 illustrates an accessory which can be used in connection with or in combination with the jewelry organizer of the present disclosure. As illustrated, the accessory is a "skin" or "overlay" for the jewelry organizer. The skin or overlay preferably is sized and shaped to correspond to the size and shape of the tray area of the jewelry organizer, and is placed onto the generally flat base portion in the tray area defined by the inner rim. In the embodiment illustrated, the skin includes a plurality of cut outs or holes each sized and shaped such that the skin can be placed around or over any existing formations in the tray area, and specifically the plurality of larger columns, two illustrated, and the plurality of smaller columns three illustrated. If the tray area is divided into one or more sections or compartments, a plurality of skins can be used and each placed within a corresponding sized and shaped compartment. A skin or overlay could also be provided for the trough area, either separate from the skin used in the tray area, or as one integral skin which would fit over the inner rim.

The skin or overlay can be made from any suitable material, e.g., cardboard, paper or laminated paper, plastic, foam, felt, fabric, etc., and can function to provide a softer surface or padding to protect the jewelry, and also to provide a decorative surface to the tray area. The decorative surface of the skin can have any suitable pattern, color, pictures, wording, company logos, etc., and can be interchangeable. The skins can be personalized by incorporating a picture or wording provided by the user prior to manufacturing.

Figure 10:
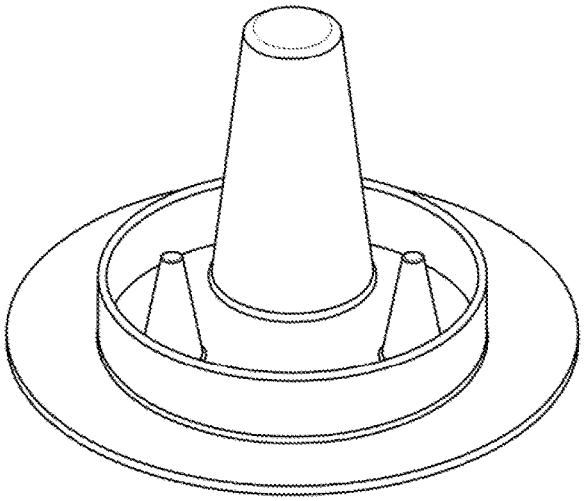
FIG. 10 is a schematic view of a first alternate embodiment of the jewelry organizer of the present disclosure.
Figure 11:
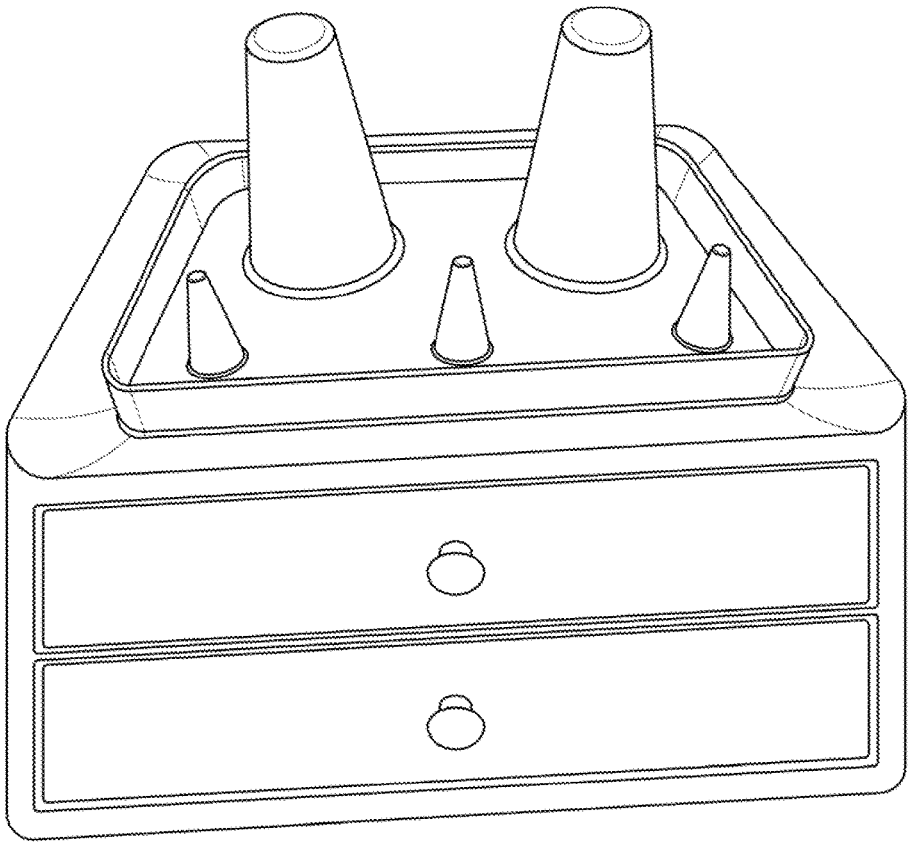
FIG. 11 is a schematic view or a second alternate embodiment of the jewelry organizer of the present disclosure.
Figure 12:
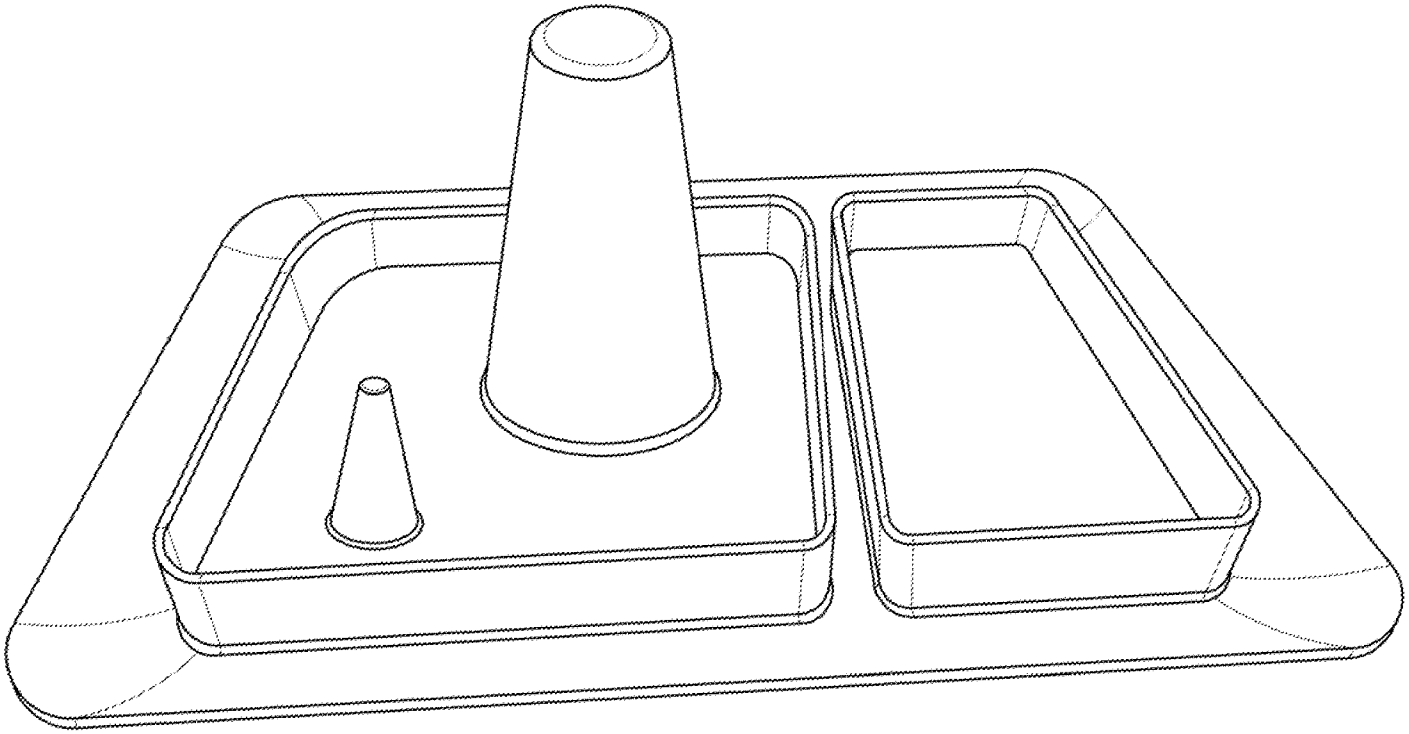
FIG. 12 is a schematic view of a third alternate embodiment of the jewelry organizer of the present disclosure.

FIGS. 10-12 depict alternate embodiments illustrating various forms the jewelry organizer of the present disclosure can take. The alternate embodiments of the jewelry organizers shown in FIGS. 10 and 12 are essentially the same as the jewelry organizer described above with respect to FIGS. 1-9, except varying in size, shape and/or the number of large and small columns.

For example, in the embodiment illustrated in FIG. 10, the jewelry organizer comprises a smaller, round version of the jewelry tray having one large column and one or more small columns (two illustrated). As above, the embodiment of FIG. 10 still has an inner rim and an outer rim which define a trough area, and the trays are still stackable.

In the embodiment illustrated in FIG. 12, the jewelry organizer comprises a rectangular tray having one large column and one or more small columns (one illustrated). Further the embodiment of FIG. 12 has a separate tray area from the tray area in which the columns are located, as defined by the inner rim. The inner rim and outer rim again define a trough area, and the trays are still stackable.

The embodiment of FIG. 11 depicts an alternate jewelry organizer tray which is adapted to be placed on or attached to a jewelry box having at least one drawer, in any suitable manner. For example, the tray can have a downwardly projecting rim which is sized and shaped to correspond to the periphery of the jewelry box on which it is placed. The downward projecting rim will extend down along a portion of the sides of the jewelry box and keep the jewelry organizer tray from sliding off the jewelry box. Alternatively, the bottom of the jewelry organizer tray can have suitable attachment means which can engage the top of the jewelry box on which it is placed. Any suitable attachment means, such as double sided tape, hoop and loop type fasteners, snaps, clips, etc., are contemplated. It is preferred that the tray can be removably and repeatedly attached to the jewelry box as desired.

Additionally, it should be understood that the skin of FIG. 9 can be sized and shaped to be placed on the alternate embodiments of the jewelry organizer trays of FIGS. 10-12.

It should be understood that the components of the device(s) or product(s) disclosed herein can take any suitable form, including any suitable materials or components capable of adequately performing their respective intended functions, as may be known in the art. Further, while the embodiment(s) are illustrative of the structure, function and operation of the exemplary device(s) or product(s) and method(s), it should be understood that various modifications may be made thereto with departing from the teachings herein.

While the foregoing discussion presents the teachings in an exemplary fashion with respect to the stackable jewelry organizer and method of using the same, it will be apparent to those skilled in the art that the present disclosure may apply to any type of device, product or method where items are to be organized, stored and displayed, especially annular items. Further, while the foregoing has described what are considered to be the best mode and/or other examples, it is understood that various modifications may be made therein and that the subject matter disclosed herein may be implemented in various forms and examples, and that the product(s) and method(s) may be applied in numerous applications, only some of which have been described herein.

What is claimed is:

1. A jewelry organizer comprising:

a one-piece tray having a flat tray surface and a tray surface perimeter defined by a periphery of the flat tray surface, the tray having a tray height at the tray surface perimeter, wherein the tray is configured to organize, store and display jewelry;

the one-piece tray further defining art least one conical column defining a column height and a longitudinal axis, the at least one conical column being integral with and extending upward from the tray surface, wherein the longitudinal axis is perpendicular to the tray surface, to hold and showcase jewelry;

wherein the column height is greater than the tray height;

an interior rim around and extending upward from the tray surface perimeter to define a tray area; and an exterior rim around the interior rim and extending outward and upward from the tray surface perimeter, wherein a trough is defined between the exterior rim and the interior rim;

wherein the exterior rim has a curved slope, and the trough defines a three dimensional space between the exterior rim and the interior rim configured to hold loose items.

2. The jewelry organizer of claim 1, wherein the at least one conical column is hollow to permit the jewelry organizer to be stackable with at least one additional jewelry organizer having a same configuration of at least one conical column, whereby the hollow of the at least one conical column of the jewelry organizer is adapted to receive the at least one conical column of the additional jewelry organizer in a nesting fashion.

3. The jewelry organizer of claim 1, further comprising a decorative, interchangeable skin or overlay having a size and shape corresponding to the flat tray surface and having at least one cutout to accommodate the at least one conical column, wherein the decorative, interchangeable skin or overlay is adapted to be removably placed on the flat tray surface to cover only the flat tray surface.

4. The jewelry organizer of claim 1, wherein the at least one conical column comprises at least two conical columns.

5. The jewelry organizer of claim 1, wherein the at least one conical column comprises at least one larger column and at least one smaller column.

6. The jewelry organizer of claim 5, wherein the at least one larger column comprises at least two larger columns.

7. The jewelry organizer of claim 5, wherein the at least one smaller column comprises at least three smaller columns.

8. The jewelry organizer of claim 5, wherein the at least one larger column consists of two larger columns and the at least one smaller column consists of three smaller columns.

9. The jewelry organizer of claim 8, wherein the at least one larger column is sized to hold and display bracelets.

10. The jewelry organizer of claim 8, wherein the at least one smaller column is sized to hold and display rings.

11. The jewelry organizer of claim 1, further comprising in combination a jewelry box, wherein the tray is adapted to be placed or attached on top of a jewelry box having at least one drawer.

12. The jewelry organizer of claim 11, wherein the tray includes a downwardly projecting rim which is sized and shaped to correspond to the periphery of the jewelry box on which it is placed, and which extends down along a portion of the sides of the jewelry box.

13. The jewelry organizer of claim 11, wherein a bottom of the tray includes an attachment element for engaging the top of the jewelry box on which it is placed.

14. The jewelry organizer of claim 13, wherein the attachment element is one of double sided tape, hoop and loop type fasteners, snaps, or clips.

15. The jewelry organizer of claim 1, wherein the tray includes at least one partition rim internal to the interior rim to partition the tray surface into a plurality of tray areas.

16. The jewelry organizer of claim 1, wherein the one-piece tray is formed of a molded plastic material.

17. A jewelry tray consisting of:

a tray surface having a tray surface perimeter defined by a periphery of the tray surface;

a tray perimeter rim around the tray surface perimeter;

a trough provided on an exterior side of the tray perimeter rim;

a first column having a first height;

a second column having a second height;

a third column having a third height;

a fourth column having a fourth height; and a fifth column having a fifth height;

wherein the first height and the second height are greater than the third height, the fourth height and the fifth height; and wherein the tray surface, the tray perimeter rim, the trough, the first column, the second column, the third column, the fourth column and the fifth column are integral and formed of a molded acrylic material.

18. A jewelry tray comprising:

a tray surface having a tray surface perimeter defined by a periphery of the tray surface;

an interior rim around and extending upward from the tray surface perimeter;

an exterior rim around the interior rim and extending outward and upward from the tray surface perimeter, wherein a trough is defined between the exterior rim and the interior rim, wherein the trough defines a space having a volume between the exterior rim and the interior rim and being configured to bold loose items in the volume of the space;

at least one conical column having a first height;

at least one other conical column having a second height;

wherein the first height is greater than the second height; and wherein the tray surface, the interior rim, the exterior rim, the at least one conical column, and the at least one other conical column are integrally formed.

19. The jewelry tray of claim 18, wherein, the at least one conical column and the at least one other conical column are hollow to permit the jewelry tray to be stackable with at least one additional jewelry tray having a same configuration of at least one conical column and at least one other conical column, whereby the hollow of the at least one conical column and the at least one other conical column of the jewelry tray are adapted to receive the at least one conical column and the at least one other conical column of the additional jewelry tray in a nesting fashion.

20. The jewelry tray of claim 18, wherein the at least one conical column consists of two conical columns having the first height and the at least one other conical column comprises three other conical columns having the second height.

* * * * *